US007044359B1

(12) United States Patent
Cohen

(10) Patent No.: US 7,044,359 B1
(45) Date of Patent: May 16, 2006

(54) TRAY

(76) Inventor: Jeremy Cohen, 35 Powerhouse Rd., Roslyn Heights, NY (US) 11577

( * ) Notice: Subject to any disclaimer, the term of this patent is extended or adjusted under 35 U.S.C. 154(b) by 345 days.

(21) Appl. No.: 10/639,341

(22) Filed: Aug. 12, 2003

(51) Int. Cl.
*B65D 5/24* (2006.01)
*B65D 5/56* (2006.01)

(52) U.S. Cl. ..... 229/122.34; 229/125.19; 229/172; 229/176; 493/98; 493/114

(58) Field of Classification Search ..... 229/122.34, 229/125.19, 172, 176; 493/95, 98, 99, 100, 493/114
See application file for complete search history.

(56) References Cited

U.S. PATENT DOCUMENTS 1,355,924 A * 10/1920 Stokes ..... 229/125.19
1,472,582 A * 10/1923 Buedingen ..... 229/125.19
1,833,492 A * 11/1931 Miller ..... 229/172
2,024,795 A * 12/1935 Claff ..... 229/182
2,084,965 A * 6/1937 Wolf ..... 229/182
RE21,158 E * 7/1939 Frankenstein ..... 229/176
2,208,268 A * 7/1940 Snyder et al. ..... 229/122.34
2,217,504 A * 10/1940 Bergstein ..... 229/172
2,996,175 A * 8/1961 Frankenstein ..... 229/172
3,136,473 A * 6/1964 Kieffer ..... 229/176
4,380,314 A * 4/1983 Langston et al. ..... 229/159
4,802,619 A * 2/1989 Laido ..... 229/125.19
6,478,217 B1 11/2002 Lombardi et al.

* cited by examiner

*Primary Examiner*—Gary E. Elkins
(74) *Attorney, Agent, or Firm*—Collard & Roe, P.C.

(57) ABSTRACT

The invention relates to a cover, an insert and a floor, and a method for manufacturing a tray therefrom. The cover comprises a planar rectangular panel with a flap on each edge, a portion of each flap being connected to an adjacent flap with a gusset, each flap having a tab at the free edge thereof, wherein the floor comprising a planar rectangle which is substantially the same size as the panel, and wherein the insert comprising a planar rectangular base which is substantially the same size as the panel, the base having a wall portion on each edge, each flap being substantially twice the size of each wall portion, wherein in use the base is aligned with the panel, the wall portions are upright, the flaps extend around the respective wall portions and the tabs are folded onto the base, the floor being aligned with the base and the panel, and being bonded to the tabs. A tray so arranged is less expensive and stronger than prior art trays. The cover is not glued to the insert, which reduces manufacturing costs and provides greater versatility in decoration options for the cover.

21 Claims, 1 Drawing Sheet

TRAY

TECHNICAL FIELD

The present invention relates to a tray or open box, and in particular, to a cover blank and a tray blank and a method for manufacturing a tray therefrom.

BACKGROUND TO THE INVENTION

It is known to combine a cover blank of paper and a tray blank of heavy card to manufacture a tray. The card is used to provide form and strength, and the paper cover is bonded to the card thereby providing structural integrity to the tray blank at the corners. In one prior construction an entire surface of the cover blank is bonded to the tray blank. The cover can be decorative so as to provide an attractive external appearance to the tray. Such trays are typically used as part of boxes for goods such as spirits, cosmetics, shoes, clothes, tobacco, toys, gifts, games and other household products. Typically such a tray is pre-assembled and delivered to a goods manufacturer or distributor ready for use.

It is further known to provide a blank of medium weight card which can be folded into the shape of a tray. Such a tray has numerous flaps and locking tabs which interlock with cut-outs to permit the tray to be erected with or without the requirement for adhesive. Typically such a tray is delivered flat to a manufacturer for assembly at the point of packaging of the goods. This type of cardboard tray is cheaper to manufacture and distribute than the tray having a paper cover. The medium weight card can be decorated, but the tray assembled therefrom is typically not as strong as the tray having an adhesively attached paper cover.

Some disadvantages are associated with the prior trays. Raw card is often exposed on the inside of the trays which is a drawback when the tray is used for presenting expensive or luxury items. The raw card may be covered by a separate lightweight cover for decoration purposes which is glued flat to the inside of the tray but this increases the manufacturing costs and may provide a non uniform appearance to the inside of the tray. In the case of the tray with a paper cover, the requirement for an entire surface of the cover to be bonded to the card increases manufacturing costs.

Both prior types of trays are often decorated to enhance their visual appearance. In the case of the paper cover the requirement for complete bonding imposes limitations on the material and decorating methods. Often the cover material is embossed prior to bonding, but the adhesive used tends to reduce the embossing effect, which is undesirable. Furthermore the paper that has the required functional characteristics for the cover cannot accept deep raised embossing, due to cracking, but such deep embossing is a desirable decorative feature. The paper cover may also be discoloured by the adhesive used. Embossing may be outward and/or inward of the tray.

When manufacturing trays of this kind it is often desirable to pre-crease the paper and/or card to aid assembly and reduce cracking or distortion at fold lines. The paper cover material does not crease well since it is a light weight material. A heavier cover material can be used to improve the creasability but this often results in a puffy appearance of a finished tray.

What is required is an improved tray.

SUMMARY OF THE INVENTION

According to a first aspect of the invention there is provided a tray, comprising a cover, an insert and a floor, wherein the cover comprises a planar rectangular panel with a flap on each edge, a portion of each flap being connected to an adjacent flap with a gusset, each flap having a tab at the free edge thereof, wherein the floor comprising a planar rectangle which is substantially the same size as the panel, and wherein the insert comprises a planar rectangular base which is substantially the same size as the panel, the base of the insert having a wall portion on each edge, each flap of the cover being substantially twice the size of each wall portion of the insert, wherein in use the base is aligned with the panel, the wall portions are upright, the flaps extend around the respective wall portions and the tabs are folded onto the base, the floor being aligned with the base and the panel, and being bonded to the tabs.

A tray so arranged is less expensive and stronger than prior art trays. The tray is of high quality and is appropriate for expensive goods. The cover is not glued to the insert, which reduces manufacturing costs and avoids the problem whereby the insert is known to be seen through the cover. The inside of the tray of the invention is completely covered by the cover and floor whereby no raw cardboard of the insert is visible, which provides a more appealing tray decoration. Due to the assembly method of the tray the cover can be of a heavy paper or light cardboard, as opposed to a light paper cover, which is advantageous for all forms of decorating. Furthermore the light cardboard is advantageous for creasing, which provides advantages in assembly of the tray. Since an entire surface of the cover is not required to be bonded to the insert, all forms of decorative methods can be utilised such as decoration, deep raised embossing, hot leaf stamping, imprinting, films, foils and mylars, and other coatings. Essentially, there is no interaction between the insert and the cover affecting the decoration of the cover.

In a preferred embodiment the insert is of card and may have a thickness in the range 0.5–3 mm. More preferably this card has a thickness in the range 0.8–2 mm. The insert may be recycled chipboard which may constitute a low grade recycled card. A high quality material for the insert may not be required since the insert is covered by the floor and the cover. The tray is capable of being manufactured with this range of thickness due to the manner in which the tray is constructed. The thickness range is wider than previously proposed in prior trays utilising an insert.

The cover is preferably of card and may be in the thickness range 0.1–0.25 mm. More preferably the cover has a thickness in the range 0.2–0.25 mm. This cover thickness is greater than prior art trays utilising an insert and a cover and is made possible by the manner in which the tray is constructed. The card permits creasing operations to be performed which thereby reduces cracking of the cover on folding. The card is capable of accepting all forms of decorating in a much preferable manner to the paper of the prior art tray with an insert.

The card of the cover and the insert and floor is preferably of a cellulose material, or of a material having similar properties to cellulose, but any flexible material could be used.

In the preferred embodiment of the cover each flap comprises an inner portion directly connected to a gusset, and an outer portion not connected to a gusset. The wall portions are of substantially the same width, and wherein the inner and outer portions are of substantially equal width, and substantially the same width as the wall portions.

Preferably the tabs are approximately 10–20 mm wide in a direction perpendicular to the edge of each flap. This tab width provides the necessary overlap to form a sufficiently strong bond with the floor and/or the insert.

Opposite flaps may be provided with secondary tabs on the outer portion thereof which may be bonded to adjacent flaps. This provides additional strength to the assembled tray. In the preferred embodiment these secondary tabs are provided on the outer portions of the flaps.

The cover of the tray may be provided with one or more apertures to provide a decorative pattern. The insert may have a decorative pattern to contrast or correspond to the one or more apertures. The insert may also be coloured.

It will be appreciated that two trays according to the invention could be provided whereby one is smaller than the other, the larger tray capable of being placed over the smaller tray to provide a box. The box may be arranged to have a window therein, the window being formed by apertures in the cover, the insert and the floor, the apertures in register to permit the interior of the box to be visible from the exterior of the box.

In yet a further alternative embodiment the cover is bonded to the insert at spaced locations to provide a decorative effect to the cover and which enhances the appearance, such as a quilted appearance.

According to a second aspect of the invention there is provided a planar cover for a tray assembly, the cover comprising a planar rectangular panel with a flap on each edge, a portion of each flap being connected to an adjacent flap with a gusset, each flap having a tab at the free edge thereof, and opposite flaps being provided with secondary tabs for attachment to adjacent flaps.

According to a further aspect of the invention there is provided a method of assembling a tray comprising the steps of:

- providing a pre-formed planar cover comprising a rectangular panel with a flap on each edge, a portion of each flap being connected to an adjacent flap with a gusset, and each flap having a tab at the free edge thereof,
- providing a planar rectangular base, the insert blank comprising a rectangular base which is substantially the same size as the panel, the base having a wall portion on each edge, and
- providing a planar rectangular floor blank, the floor blank comprising a rectangle which is substantially the same size as the panel,
- placing the base on the panel,
- folding the walls upright so that the insert forms a tray-like shape,
- folding each gusset inward of the tray-like shape,
- folding the flaps over the walls,
- folding the tabs onto the base, and
- placing the floor onto the base whereby the floor is aligned with the base thereby covering the tabs,
- and bonding the floor to the tabs to provide the assembled tray.

The method may further comprise the step of providing opposite flaps with secondary tabs and adhesively bonding the secondary tabs to the adjacent flaps. Secondary tabs so arranged and bonded to adjacent flaps advantageously provide the assembled tray with additional strength.

BRIEF DESCRIPTION OF DRAWINGS

Other features of the invention will be apparent from the following description of a preferred embodiment shown by way of example only in the accompanying drawings, in which.

DESCRIPTION OF PREFERRED EMBODIMENT

Figure 1:
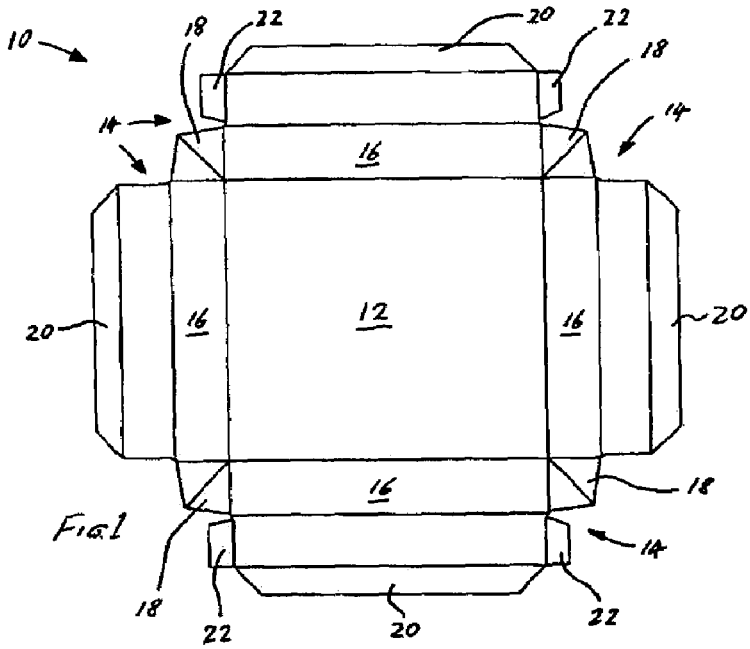
FIG. 1 is a plan view of a cover blank for a tray according to the present invention.

Referring firstly to FIG. 1 there is shown an unfolded (planar) cover blank for a tray according to the present invention, generally designated 10. The cover 10 comprises a rectangular panel 12 with a flap 14 appended to each side of the panel 12. A portion 16 of each flap 14 is connected to an adjacent flap 14 with a gusset 18. Each flap 14 has a tab 20 appended thereto. Two opposing flaps 14 are further provided with secondary tabs 22. The cover 10 is of light card which is typically in the thickness range 0.1–0.25 mm.

Figure 2:
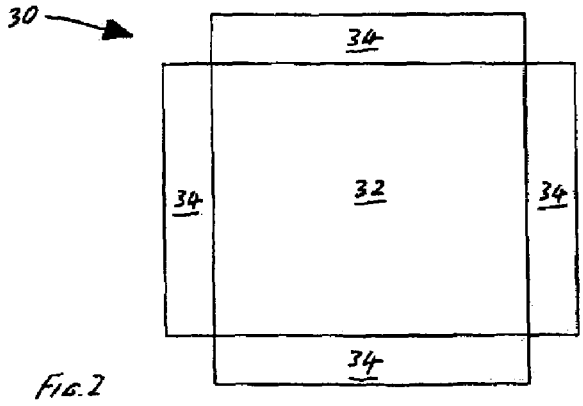
FIG. 2 is a plan view of an insert blank for the tray manufactured with the blank of FIG. 1.

FIG. 2 is a plan view of an unfolded insert blank for the tray manufactured with the blank of FIG. 1, generally designated 30. The insert 30 comprises a rectangular base 32 which is substantially the same size as the panel 12. The base 32 has a wall 34 appended to each side. The insert 30 is of heavy cardboard and is typically in the range 0.5–3 mm. The walls 34 are intended to be folded-up at right angles, and are of the same height.

Figure 3:
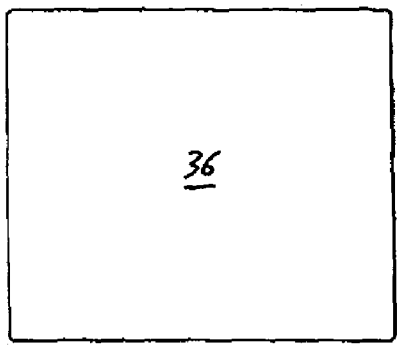
FIG. 3 is a plan view of a floor for the tray manufactured from the blank of FIG. 1.

FIG. 3 is a plan view of a floor 36 for the tray manufactured from the blank of FIG. 1. The floor 36 is of the same light card as the cover 10. The floor 36 comprising a rectangle which is substantially the same size as the panel 12.

Assembly of a tray according to the present invention will now be described. The insert 30 is placed on the blank 10 so that the base 32 is aligned with the panel 12. The four walls 34 of the insert 30 are each folded-up by 90° so that the insert form a tray-like shape. The gussets 18 are then folded inwards to the tray which raises the flaps 14 by 90° thereby positioning the portions 16 against the walls 34. The remaining portion of each of the flaps 14 is then folded over each wall 34 of the insert 12. Each of the four tabs 20 are then folded so that they make contact with the base 32. The floor 36 is then located in the tray so that it is aligned with the base 32 and panel 30. The floor 36 is then bonded to the tabs 20 to form an assembled tray.

It will be appreciated that numerous variations in assembly of the cover 10, insert 30 and floor 36 are possible together with the step of application of adhesive, without departing from the scope of the invention. It will also be appreciated that two trays according to the invention could be manufacture whereby one is smaller than the other, the larger tray capable of being placed over the smaller tray to provide a closure therefor.

The invention claimed is:

1. A tray comprising a cover, an insert and a floor, wherein the cover comprises a planar rectangular panel with a flap on each edge, a portion of each flap being connected to an adjacent one of said flaps with a gusset, each flap having a tab at the outside edge thereof, wherein the floor comprising a planar rectangle which is substantially the same size as the panel, and wherein the insert comprises a planar rectangle base which is substantially the same size as the panel, and wherein the insert comprises a planar rectangular base which is substantially the same size as the panel, the base of the insert having a wall portion on each edge, each flap of the cover being substantially twice the size of each wall portion of the insert, wherein in use the floor is aligned with the panel, the wall portions are upright, the flaps extend around the respective wall portions and the tabs are folded onto the base, the floor being aligned with the base and the panel, and being bonded to the tabs.

2. A tray according to claim 1, wherein each flap comprises an inner portion directly connected to a gusset.

3. A tray according to claim 2 wherein the wall portions are of substantially the same width, and wherein the inner and outer portions are of substantially equal width, and substantially the same width, and substantially the same width as the wall portions.

4. A try according to claim 1, wherein an opposite one of said flaps are provided with secondary tabs bonded to an adjacent one of said flaps.

5. A tray according to claim 4, wherein the secondary tabs are provided on the outer portion of at least one of the flaps.

6. A tray according to claim 1, wherein the tabs are in the range 10–20 mm wide.

7. A tray according to claim 1, wherein the insert is of card.

8. A tray according to claim 7, wherein the card has a thickness in the range 0.5–3 mm.

9. A tray according to claim 7, wherein the card has a thickness is in the range 0.8–2 mm.

10. A tray according to claim 7, wherein the card is comprised of recycled chipboard.

11. A tray according to claim 1, wherein the cover is of card.

12. A tray according to claim 11, wherein the card has a thickness in the range 0.1–0.25 mm.

13. A tray according to claim 12, wherein the cover has a thickness in the range 0.2–0.25 mm.

14. A tray according to claim 1, wherein the cover is bonded to the insert at spaced locations.

15. A tray according to claim 1, wherein the cover is provided with one or more apertures.

16. In combination two trays according to claim 1 whereby one tray is smaller than the other tray, the larger tray capable of being placed over the smaller tray, in use, to provide a box.

17. A combination according to claim 16, wherein the box has a window therein, the window being formed by apertures in the cover, the insert and the floor, the apertures in register to permit the interior of the box to be visible from the exterior of the box.

18. A tray comprising:

a) cover comprising i) a planar rectangular panel having a flap on each edge;

ii) a gusset coupling at least one flap to an adjacent one of said flaps; and iii) at least one tab coupled to at least one flap;

b) an insert comprising i) a planar rectangular base which is substantially the same size as said planar rectangular panel; and ii) a wall portion on each edge of said base wherein each flap of said cover is at least substantially twice the size of each wall portion of said insert; and c) a floor, comprising a planar rectangle which is substantially the same size as the panel, wherein in use, said floor is aligned with the panel, said wall portions are upright, said flaps extend around the respective wall portions and wherein said at least one tab is folded onto said planar rectangular base, wherein said floor is aligned with said planar rectangular base and said planar rectangular panel, and which is coupled to said at least one tab.

19. The device as in claim 18, wherein said cover comprises at least three flaps each having at least one tab coupled to the outside end thereof.

20. A method of assembling a tray comprising the steps of:

providing a pre-formed planar cover comprising a rectangular panel with a flap on each edge, a portion of each flap being connected to an adjacent one of said flaps with a gusset, and at least one flap having a tab at the outside edge thereof, providing a planar rectangular base, the insert blank comprising a rectangular base which is substantially the same size as the panel, the base having a wall portion on each edge, and providing a planar rectangular floor blank, the floor blank comprising a rectangle which is substantially the same size as the panel, placing the base on the panel, folding the walls upright so that the insert forms a tray-like shape, folding each gusset inward of the tray-like shape, folding the flaps over the walls, folding at least one of the tabs onto the base, placing the floor onto the base whereby the floor is aligned with the base thereby covering at least one of the tabs, and coupling the floor to the tabs to provide the assembled tray.

21. A method according to claim 20, further comprising the step of providing opposite flaps with secondary tabs and adhesively bonding the secondary tabs to said flaps positioned adjacent to each other.

* * * * *